US006167343A

United States Patent [19]

Bauerle

[11] Patent Number: 6,167,343

[45] Date of Patent: Dec. 26, 2000

[54] METHOD OF GOVERNING ACCELERATION IN A VEHICLE THROTTLE CONTROL SYSTEM

[75] Inventor: Paul Alan Bauerle, Fenton, Mich.

[73] Assignee: General Motors Corporation, Detroit, Mich.

[21] Appl. No.: 09/455,746

[22] Filed: Aug. 2, 1999

[51] Int. Cl.[7] ..... F02D 11/10; F02D 41/10

[52] U.S. Cl. ..... 701/110; 123/350; 123/396

[58] Field of Search ..... 701/110; 123/350, 123/396

[56] References Cited

U.S. PATENT DOCUMENTS

| | | | |
|---|---|---|---|
| 4,707,792 | 11/1987 | Naitou | 701/110 |
| 5,297,064 | 3/1994 | Bauerle | 702/98 |
| 6,021,370 | 2/2000 | Bellinger et al. | 701/110 |

*Primary Examiner*—Andrew M. Dolinar
*Attorney, Agent, or Firm*—Anthony Luke Simon

[57] ABSTRACT

An improved method of governing vehicle acceleration in which desired throttle area is initialized to an open-loop, vehicle speed dependent, value at the onset of vehicle acceleration governing, and is thereafter updated based on a combination of open-loop, and proportional and integral closed-loop terms. The open-loop term is calibrated to produce a throttle area limit for controlling the vehicle acceleration on flat terrain with nominal loading at sea level, while the proportional and integral terms compensate for terrain inclination, loading and altitude, yielding an optimal balance of smoothness and response time. The open-loop term may be empirically determined as a function of both vehicle speed and barometric pressure, and the vehicle acceleration is computed using a least squares approximation of acceleration based on successively measured values of vehicle speed.

10 Claims, 2 Drawing Sheets

METHOD OF GOVERNING ACCELERATION IN A VEHICLE THROTTLE CONTROL SYSTEM

TECHNICAL FIELD

This invention relates to a method of operation for a vehicle electronic throttle control (ETC) system, and more particularly to a method of using the throttle control system to govern the vehicle acceleration during periods of engine power limiting.

BACKGROUND OF THE INVENTION

In a vehicle ETC system, the engine throttle is mechanically de-coupled from the driver operated accelerator pedal, and instead is positioned by an electric motor under the control of an electronic control module (ECM). The motor is activated to position the throttle in response to accelerator pedal movement, but can also be controlled to achieve other functions such as idle speed control, engine speed governing, cruise control, torque reduction for traction control, and vehicle acceleration governing. In general, the ECM or another controller determines a desired effective throttle area to achieve a given function, and the ECM activates the motor to move the throttle to a position corresponding to the desired throttle area.

The present invention concerns an improved method of vehicle acceleration governing in an ETC system. The acceleration governing function is typically requested under certain failure mode conditions, and operates under such conditions to limit the vehicle acceleration to a threshold value, which may be determined based on vehicle speed. In conventional systems, this involves a proportional-plus-integral (PI) closed-loop control which develops a throttle area command for driving the measured vehicle acceleration into correspondence with the threshold value. However, the throttle area required to maintain a given vehicle acceleration tends to increase exponentially with increasing vehicle speed. This makes the conventional proportional and integral closed-loop terms work harder to regulate the vehicle acceleration, tending to result in instability at low vehicle speeds and excessive limiting at high vehicle speeds.

SUMMARY OF THE INVENTION

The present invention provides an improved method of governing vehicle acceleration in which desired throttle area is initialized to an open-loop, vehicle speed dependent, value at the onset of vehicle acceleration governing, and is thereafter updated based on a combination of open-loop, and proportional and integral closed-loop terms. The open-loop term is calibrated to produce a throttle area limit for controlling the vehicle acceleration on flat terrain with nominal loading at sea level, while the proportional and integral terms compensate for terrain inclination, loading and altitude, yielding an optimal balance of smoothness and response time. In a preferred embodiment, the open-loop term is empirically determined as a function of both vehicle speed and barometric pressure, and the vehicle acceleration is computed using a least squares approximation of acceleration based on successively measured values of vehicle speed.

DESCRIPTION OF THE PREFERRED EMBODIMENT

Figure 1:
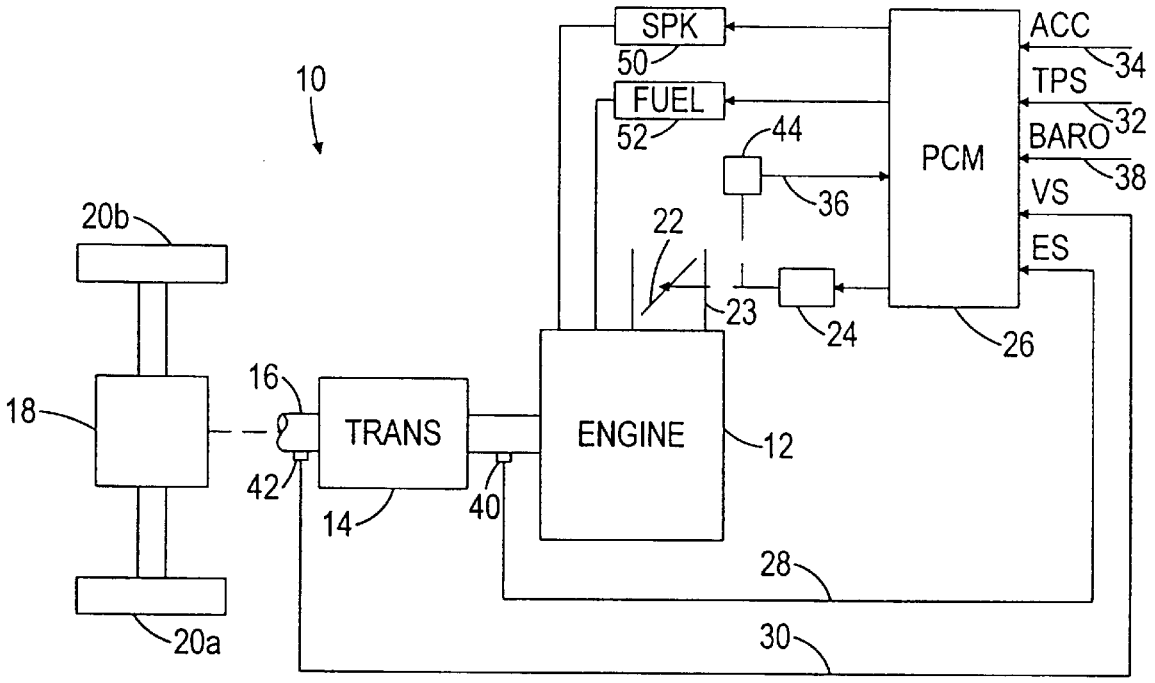
FIG. 1 is a schematic diagram of a vehicle having an electronic throttle control system according to this invention, including an electronic control unit.

Referring to the drawings, and particularly to FIG. 1, the reference numeral 10 generally designates a vehicle drive train including an engine 12 coupled to a multiple-speed ratio transmission 14, which in turn is coupled via drive shaft 16 and differential 18 to a pair of driven wheels 20*a*–20*b*. The position of a throttle 22 disposed within an intake manifold 23 of engine 12 is controlled to produce power for driving the wheels 20*a*–20*b*. The throttle 22 is mechanically de-coupled from a driver-manipulated accelerator pedal (not shown) and instead is positioned by an electric motor 24 under the control of a powertrain control module (PCM) 26, which also controls the operation of engine 12 and transmission 14. The PCM 26 is microprocessor based and operates in response to a number of inputs, including an engine speed signal ES on line 28, a vehicle speed signal VS on line 30, an accelerator pedal position signal TPS on line 32, an accessory loading signal ACC on line 34, a throttle position feedback signal on line 36, and a barometric or ambient air pressure signal BARO on line 38. These inputs are provided by various conventional sensors such as the illustrated shaft speed sensors 40, 42 and throttle position sensor 44. In general, the PCM 26 activates motor 24 to position the throttle 22 in accordance with a desired throttle area TAdes determined in response to accelerator pedal position and various control functions such as idle speed control, engine governor control, cruise control, and traction control. Additionally, the PCM 26 controls conventional spark and fuel control devices 50, 52 coupled to engine 12.

Figure 2:
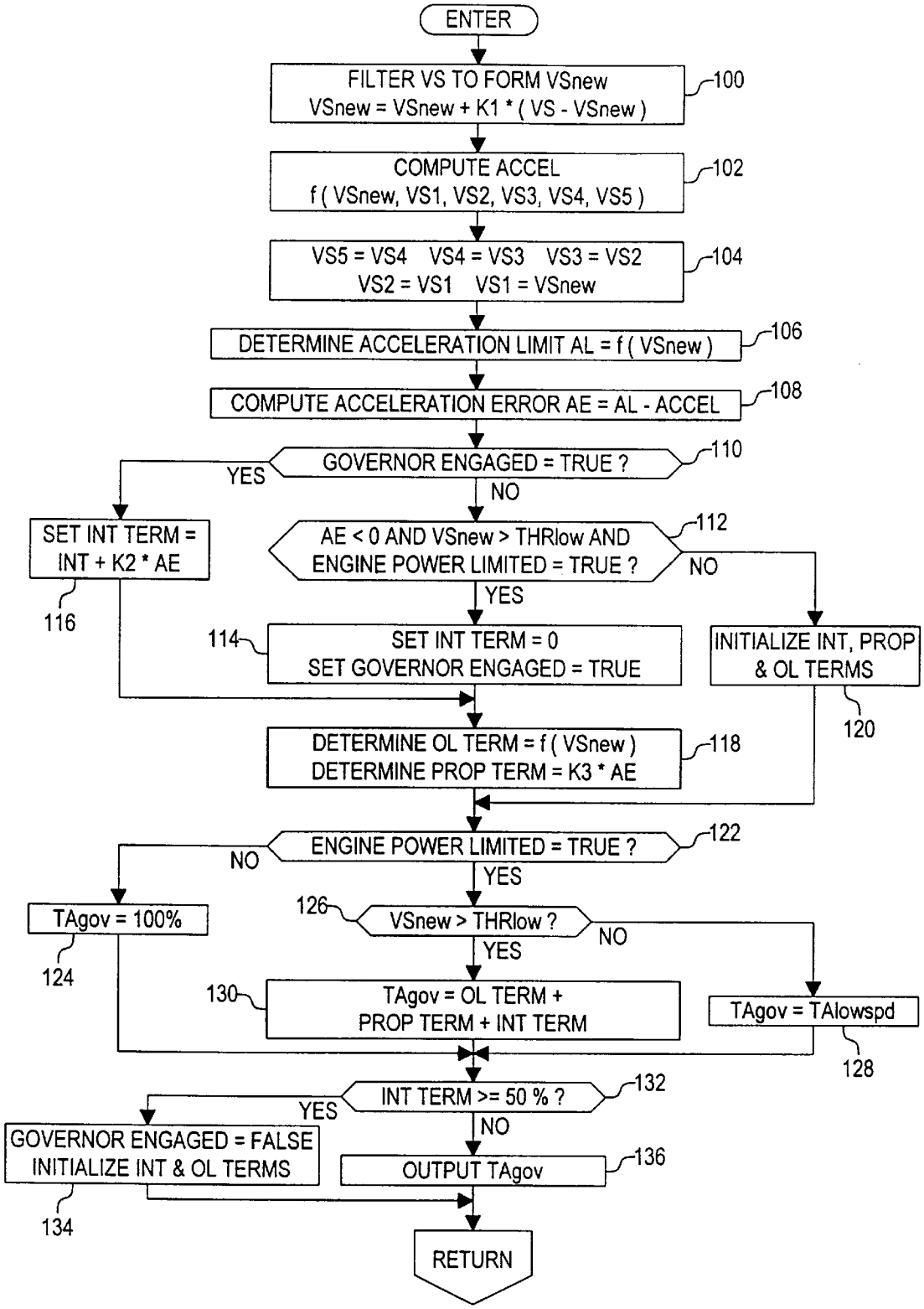
FIG. 2 is a flow diagram representative of computer program instructions executed by the electronic control unit of FIG. 1 in carrying out the acceleration governing control of this invention.

According to this invention, the PCM 26 controls the motor 24 during periods of engine power limiting so as to limit the vehicle acceleration to a limit value based on vehicle speed. The control is best described in reference to the flow diagram of FIG. 2, which represents a software routine periodically executed by PCM 26. Initially, block 100 is executed to read and filter the vehicle speed signal VS, forming a filtered vehicle speed term VSnew. The vehicle speed information may be obtained from a number of alternate sources in addition to the sensor 42 of FIG. 1. For example, the vehicle speed information may be obtained from ABS wheel speed sensors, or from engine speed and gear; these other sources may be used to confirm or validate the vehicle speed signal obtained from sensor 42, if desired. The filter function is preferably a simple first-order lag filter, as may be represented by the equation:

$$VSnew=VSnew+K1(VS-VSnew)$$

where K1 is a filter gain constant, such as 0.4. Initially, the term VSnew may be set equal to VS.

Successively determined values of VSnew (designated in FIG. 2 as VSnew, VS1, VS2, VS3 VS4 and VS5) are stored by the PCM 26 for the purpose of computing the vehicle acceleration ACCEL, as indicated at blocks 102 and 104. In other words, the vehicle acceleration term ACCEL is computed as a combined function of the six most recent values of VSnew. Preferably, the computation involves a least squares approximation of the speed derivative, represented algebraically as follows:

$$ACCEL=(5*VSnew+3*VS1+VS2-VS3-3*VS4-5*VS5)/7$$

This approximation is easily computed, is very tolerant to noise, and avoids the lag associated with heavy filtering. As noted at block 104, VSnew becomes VS1, VS1 becomes VS2, and so on, after ACCEL is computed at block 102.

The blocks 106 and 108 are then executed to determine an acceleration limit AL, and to compute the acceleration error AE according to the difference (AL−ACCEL). As indicated at block 106, the acceleration limit AL may be determined based on the filtered vehicle speed VSnew.

The block 110 tests the status of the flag referred to herein as GOVERNOR ENGAGED, the status of such flag being TRUE if vehicle acceleration governing is in effect, and otherwise FALSE. As indicated at blocks 112 and 114, vehicle acceleration governing is engaged whenever AE is negative (indicating acceleration in excess of the limit AL), VSnew is greater than a low speed threshold THRIow, and the PCM 26 is in a engine power limiting mode of operation. The threshold THRIow corresponds to a low vehicle speed such as 5 MPH, for which the vehicle speed signal VS tends to be inaccurate. When vehicle acceleration governing is initially engaged, the closed-loop integral term INT of the throttle area calculation is reset to zero, as indicated by the block 114. In subsequent executions of the routine, block 110 is answered in the affirmative, and block 116 updates the integral term INT according to the sum (INT +K2*AE), where K2 is the integral gain factor. The other two terms of the throttle area calculation—the open loop term OL and the proportional term PROP—are then determined at block 118. The proportional term PROP is determined according to the product (K3*AE), whereas the open loop term OL is independent of the acceleration error AE, as explained below. If the conditions of block 112 are not met, the block 120 is executed to initialize the integral, proportional and open-loop terms INT, PROP, OL to predetermined inactive values; that is, the terms are initialized so that the throttle area calculation will produce a high governed throttle area TAgov, such as 100%.

If the engine power limiting mode is discontinued after the throttle area terms INT, PROP and OL have been determined, as detected at block 122 the block 124 sets the governed throttle area TAgov to 100%. If the vehicle speed VSnew falls below the threshold THRlow, as detected at block 126, the block 128 initializes the governed throttle area TAgov to a predetermined low-speed area designated at TAlowspd. However, if blocks 122 and 124 are answered in the affirmative, the block 130 is executed to compute the governed throttle area TAgov according to the sum of the OL, PROP and INT terms.

Vehicle acceleration governing is terminated at block 134 when the measured acceleration ACCEL drops off the point where the integral term INT reaches a positive threshold such as 50%, as detected at the block 132. At such point, the GOVERNOR ENGAGED flag is set to FALSE, and the INT and OL terms are re-initialized before exiting the routine. However, if block 132 is answered in the negative, acceleration governing is active, and the block 136 is executed to provide the governed throttle area TAgov as an output to the PCM 26, which suitably limits the otherwise requested throttle area. For example, the PCM 26 can set the desired throttle area TAdes equal to the lower of a requested throttle area TAreq and the governed throttle area TAgov.

According to this invention, the open loop term OL of the governed throttle area computation is obtained as a function of vehicle speed VSnew from a table of throttle areas designed to govern the vehicle acceleration at the desired limit AL (also a function of vehicle speed) on flat terrain with nominal loading at sea level. In contrast, the proportional and integral terms PROP, INT vary with the acceleration error, and serve to compensate for terrain inclination, loading and altitude. Thus, when vehicle acceleration governing is engaged, the throttle 22 is immediately positioned in accordance with the sum of the open-loop and proportional terms OL and PROP, and the integral term thereafter builds as required to compensate for inclination, loading and altitude. In a preferred embodiment, the open-loop term OL is stored as a function of both vehicle speed and barometric pressure, to thereby compensate for both vehicle speed and altitude. In this case, the integral term INT only has to compensate for inclination and loading.

With the above-described control, vehicle acceleration governing can be carried out with a high degree of stability and accuracy. While this invention has been described in reference to the illustrated embodiment, it is expected that various modifications in addition to those suggested above will occur to those skilled in the art. In this regard, it will be understood that the scope of this invention is not limited to the illustrated embodiment, and that controls incorporating such modifications may fall within the scope of this invention, which is defined by the appended claims.

What is claimed is:

1. A motor vehicle control in which an engine throttle is electronically positioned in response to a requested throttle area developed by an electronic controller, where the controller limits the requested throttle area during an engine power limiting mode in order to limit vehicle acceleration to a determined acceleration limit, the improvement wherein the controller:

determines an open-loop throttle area for maintaining the determined acceleration limit on flat terrain with nominal vehicle loading;

determines an acceleration of the vehicle based on successively measured values of vehicle speed;

determines a closed-loop throttle area based on a deviation of the determined acceleration from said acceleration limit;

calculates a governed throttle area based on a combination of said open-loop and closed-loop throttle areas; and limits the requested throttle area to said governed throttle area.

2. The improvement of claim 1, wherein the acceleration of the vehicle is determined by a computing a least squares approximation of acceleration based on said successively measured values of vehicle speed.

3. The improvement of claim 1, wherein said closed-loop throttle area includes a proportional term and an integral term.

4. The improvement of claim 1, wherein the controller determines the open-loop throttle area from a table of throttle areas stored as a function of vehicle speed.

5. The improvement of claim 1, wherein the controller determines the open-loop throttle area from a table of throttle areas stored as a function of vehicle speed and atmospheric pressure.

6. A motor vehicle acceleration governing method for a system in which an engine throttle is electronically positioned in response to a requested throttle area, comprising the steps of:

determining a vehicle acceleration limit based on a measure of vehicle speed;

determining an open-loop throttle area for maintaining the determined acceleration limit on flat terrain with nominal vehicle loading;

computing an acceleration of the vehicle based on successively measured values of vehicle speed;

determining a closed-loop throttle area based on a deviation of the computed acceleration from the determined acceleration limit;

calculating a governed throttle area based on a combination of said open-loop and closed-loop throttle areas; and limiting the requested throttle area to said governed throttle area.

7. The acceleration governing method of claim 6, wherein the step of computing the acceleration of the vehicle includes computing a least squares approximation of acceleration based on said successively measured values of vehicle speed.

8. The acceleration governing method of claim 6, wherein said closed-loop throttle area includes a proportional term and an integral term.

9. The acceleration governing method of claim 6, wherein the step of determining an open-loop throttle area includes the step of retrieving an open-loop throttle area from a table of throttle areas stored as a function of vehicle speed.

10. The acceleration governing method of claim 6, wherein the step of determining an open-loop throttle area includes the step of retrieving an open-loop throttle area from a table of throttle areas stored as a function of vehicle speed and atmospheric pressure.

* * * * *